US005087105A

United States Patent [19]

White

[11] Patent Number: 5,087,105

[45] Date of Patent: Feb. 11, 1992

[54] EARRING RACK

[76] Inventor: James M. White, Rte. 8, Box 260AA, Fairmont, W. Va. 26554-8613

[21] Appl. No.: 590,922

[22] Filed: Oct. 1, 1990

[51] Int. Cl.[5] ..... A47B 67/02

[52] U.S. Cl. ..... 312/245; 211/13; 206/566

[58] Field of Search ..... 211/13, 90, 94, 60.1, 211/163; 206/566, 486; 312/245, 246; 108/152, 153

[56] References Cited

U.S. PATENT DOCUMENTS 2,051,406 8/1936 Green ..... 248/477
3,782,558 1/1974 Schael ..... 211/13
4,209,212 6/1980 McGoldrick ..... 312/245
4,420,084 12/1983 Whelan ..... 211/13
4,775,053 10/1988 Geiger ..... 211/13

*Primary Examiner*—Kenneth J. Dorner
*Assistant Examiner*—Gerald A. Anderson
*Attorney, Agent, or Firm*—Michael I. Kroll

[57] ABSTRACT

An improved earring rack is provided and consists of a grid frame for removably holding the hook earrings thereon and two shutters, each having a plurality of small holes for removably holding post earrings with their respective friction nuts thereon. Each shutter is hinged to one side of the grid frame so that the shutters can be swung centerwards for the post earrings to be removed easily. The grid frame is mounted in a stationary vertical position to prevent the rack from falling over when the earrings are being removed therefrom.

7 Claims, 2 Drawing Sheets 20
18
36
38
26
12
40
22
24
28
10
26
16
38
28
40
24
3
38
46
53
56
OPTIONAL TRAY
24
53
38
18
22
18
20
12
26
28
53
46
54

12
45
26
46
53

EARRING RACK

BACKGROUND OF THE INVENTION

1. Field of the Invention

The instant invention relates generally to jewelry display cases and more specifically it relates to an improved earring rack.

2. Description of the Prior Art

Numerous jewelry display cases have been provided in prior art that are adapted to receive, store, carry, organize and display articles of jewelry. While these units may be suitable for the particular purpose to which they address, they would not be as suitable for the purposes of the present invention as heretofore described.

SUMMARY OF THE INVENTION

A primary object of the present invention is to provide an improved earring rack that will overcome the shortcomings of the prior art devices.

Another object is to provide an improved earring rack that can be permanently attached to a wall to prevent the rack from falling over when earrings are removed therefrom.

An additional object is to provide an improved earring rack in which the earrings are displayed therefrom in a neat organized fashion and can be quickly removed from and re-attached to the rack.

A further object is to provide an improved earring rack that is simple and easy to use.

A still further object is to provide an improved earring rack that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 3A:
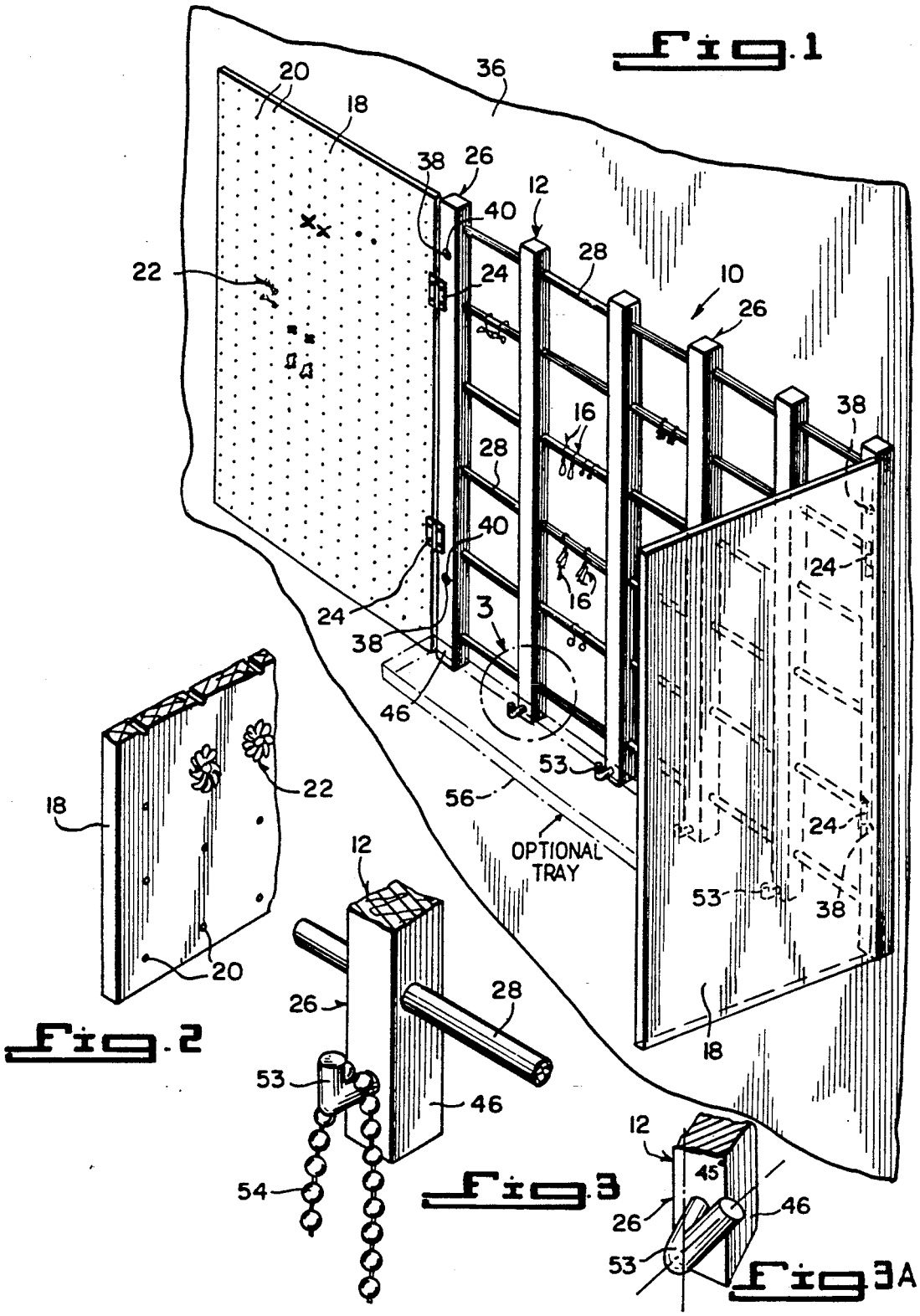
FIG. 1 is a front perspective view of the instant invention mounted to a wall.
FIG. 2 is an enlarged front perspective view of a portion of one of the shutters.
FIG. 3 is an enlarged front perspective view of a portion of the grid frame as indicated by arrow 3 in FIG. 1 showing one of the hangers in greater detail.
FIG. 3A is an enlarged front perspective view of a portion of the grid frame showing the hanger turned at a forty five degree angle to the vertical stanchion.

Turning now descriptively to the drawings, in which similar reference characters denote similar elements throughout the several views, the figures illustrate an improved earring rack 10 consisting of a grid frame 12 for removably holding hook earrings 16 thereon in a neat organized fashion. Two shutters 18 are provided, in which each have a plurality of small holes 20 for removably holding the post (not shown) of earrings 22 with their respective friction nuts thereon in a neat organized fashion.

Each shutter 18 is secured along one edge by at least one hinge 24 to one side of the grid frame 12 so that the shutters 18 can be swung centerwards for the post earrings 22 to be removed easily. The grid frame 12 is mounted in a stationary vertical position to prevent the rack 10 from falling over when the earrings 16 and 22 are being removed therefrom.

The grid frame 12 includes a plurality of vertical stanchions 26 and a plurality of horizontal rungs 28 which transversely enter the stanchions 26 so that the hook earrings 16 can be removably held thereto.

Figure 4:
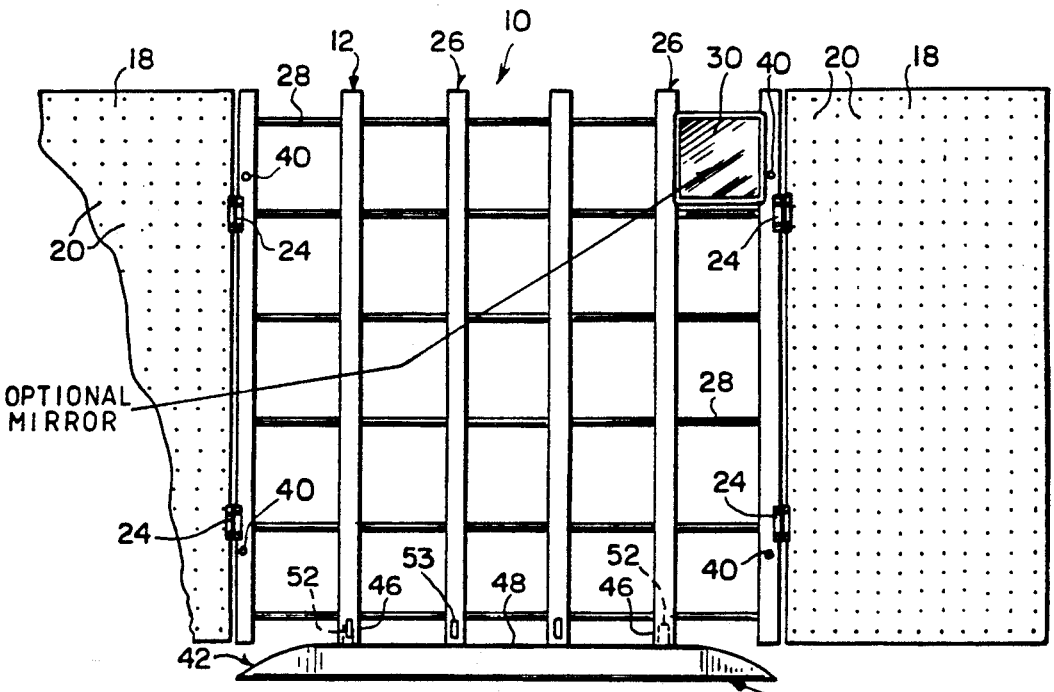
FIG. 4 is a front elevational view of the invention attached to an optional stand.
Figure 5:
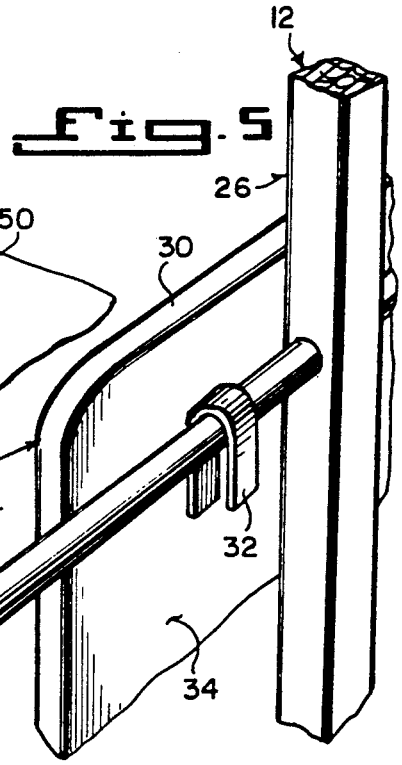
FIG. 5 is an enlarged rear perspective view of a portion of the grid frame showing the optional mirror attached to a horizontal rung.

As shown in FIGS. 4 and 5, an optional mirror 30 can be removably attached to one of the horizontal rungs 28 of the grid frame 12 by an inverted U-shaped clip 32 affixed to the back 34 of the mirror 30.

Figure 6:
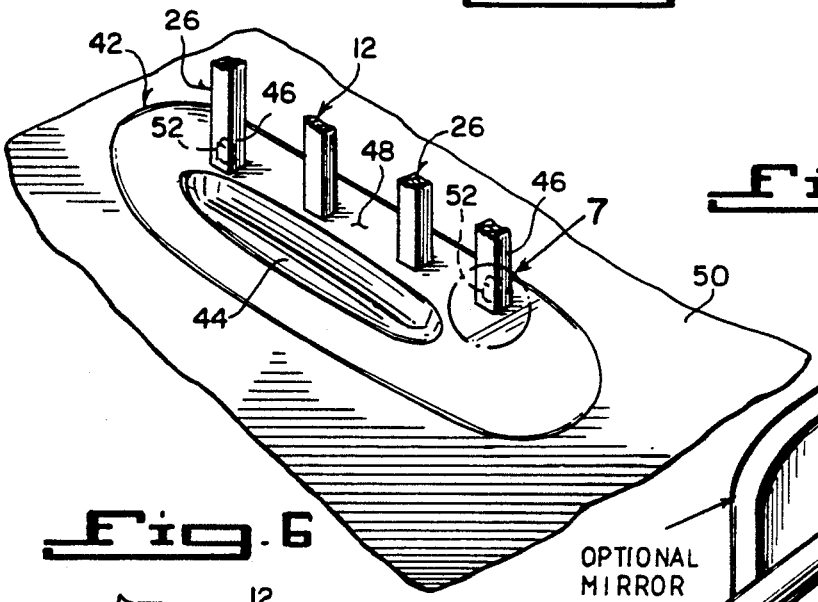
FIG. 6 is a front perspective view of the optional stand used in FIG. 4.
Figure 7:
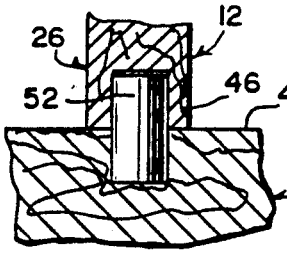
FIG. 7 is an enlarged cross sectional view as indicated by arrow 7 in FIG. 6 showing an attachment pin used in connecting the bottom end of one of the vertical stanchions to the top of the stand.

As shown in FIG. 1, the grid frame 12 is preferably mounted to a wall 36 by screws 38 passing through apertures 40 in the vertical stanchions 26. As shown in FIGS. 4, 6 and 7, an optional stand 42 can be provided having a recess 44 for holding therein extra friction nuts (not shown) for the post earrings 22 and other small objects. The bottom ends 46 of the vertical stanchions 26 are attached to the top 48 of the stand 42 which rests on a flat horizontal surface 50, such as a table or the like. For attachment a pin 52, as best seen in FIG. 7, can extend from within the top 48 of the stand 42 into the bottom end 46 of a vertical stanchion 26.

As best seen in FIGS. 3 and 3A, a hanger 53 can be attached to the bottom 46 of each vertical stanchion 26 for holding a necklace or bracelet 54 therefrom when the rack 10 is mounted to the wall 36. The hanger 52 can be placed vertical with respect to the stanchion 26, as in FIG. 3 or at an angle, such as at forty five degrees, in FIG. 3A. An optional tray 56, shown in phantom in FIG. 1, can also be attached to the front of the bottom ends 46 of the vertical stanchions 26 for holding thereon extra friction nuts of the post earrings 22 and other small objects.

The rack 10 can be made in different sizes and be fabricated out of plastic, wood, metal or other durable materials. The rack 10 can also be in different colors to match the decor of the room it is to be used in.

LIST OF REFERENCE NUMBERS

10 improved earring rack
12 grid frame
14 loop
16 hook earring
18 shutter
20 small hole in 18
22 post earring
24 hinge
26 vertical stanchion
28 horizontal rung
30 optional mirror 32 inverted U-shaped clip
34 back of 30
36 wall
38 screw
40 aperture in 26
42 optional stand
44 recess in 42
46 bottom end of 26
48 top of 42
50 horizontal flat surface
52 attachment pin
53 hanger
54 necklace or bracelet
56 optional tray It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved supportless earring rack, comprising:
   a) a grid frame having holes in the vertical members and cylindrical shaped horizontal members and a center for removably holding the hook of earrings thereon in a neat organized fashion, said horizontal members are cylindrically shaped and pass through said vertical members, said grid frame including a plurality of vertical stanchions and a plurality of cylindrically shaped horizontal rungs which transversely pass through said stanchions so that the hook earrings can be removably held thereto;
   b) two shutters, each having a plurality of small holes for removably holding the posts earrings with their respective friction nuts therein in a neat organized fashion, said shutters meeting in said center of said frame.
   c) means for securing one edge of each said shutter to one side of said grid frame so that said shutters can be swung centerwards for the post earrings to be removed easily;
   d) means for mounting said grid frame in a stationary vertical position to prevent said rack from falling over when the earrings are being removed therefrom; and
   e) a mirror and means for removably attaching said mirror to one of said horizontal rungs of said grid frame, said removably attaching means is an inverted U-shaped clip affixed to the back of said mirror.

2. An improved earring rack as recited in claim 1, wherein said shutter securing means includes at least one hinge.

3. An improved earring rack as recited in claim 1, wherein said grid frame mounting means includes a plurality of screws extending through said vertical stanchions for attaching said vertical stanchions to a wall.

4. An improved earring rack as recited in claim 3, further including a plurality of hangers, each attached to a bottom end of one of said vertical stanchions for holding a necklace/bracelet therefrom.

5. An improved earring rack as recited in claim 3, further including a tray attached to the front of the bottom ends of said vertical stanchions for holding thereon extra friction nuts of the post earrings and other small objects.

6. An improved earring rack as recited in claim 1, wherein said grid frame mounting means includes:
   a) a stand having a recess for holding therein extra friction nuts for the post earrings and other small objects; and
   b) means for attaching the bottom ends of said vertical stanchions to the top of said stand which rests on a flat horizontal surface.

7. An improved earring rack as recited in claim 6, wherein said attaching means includes a plurality of pins, each extending from within the top of said stand into the bottom end of one of said vertical stanchions.

* * * * *